United States Patent [19]

Correa

[11] 3,945,338

[45] Mar. 23, 1976

[54] LOCATION INDICATOR FOR LOST AIRCRAFT

[76] Inventor: Affonso Henriques Correa, 3040 Idaho Ave., N.W., Apt. 316, Washington, D.C. 20016

[22] Filed: Nov. 13, 1974

[21] Appl. No.: 523,540

[52] U.S. Cl. ..... 116/124 B; 9/9; 116/DIG. 9

[51] Int. Cl.[2] ..... G09F 9/00

[58] Field of Search ..... 116/124 B, DIG. 8, DIG. 9; 9/9; 46/90, 88, 87; 343/706; 23/281; 280/150 AB

[56] References Cited

UNITED STATES PATENTS

| | | | |
|---|---|---|---|
| 1,836,495 | 12/1931 | Paulson | 116/124 B |
| 2,395,006 | 2/1946 | Leslie | 116/124 B |
| 2,439,598 | 4/1948 | Dinsley | 9/9 |
| 2,881,276 | 4/1959 | Mintz | 200/61.45 R |
| 2,923,917 | 2/1960 | McPherson | 116/124 B |
| 3,117,424 | 1/1964 | Hebenstreit | 23/281 |
| 3,122,181 | 2/1964 | Hebenstreit et al. | 23/281 |
| 3,123,842 | 3/1964 | Oeland | 116/124 B |
| 3,310,024 | 3/1967 | McConnell | 46/90 |
| 3,723,205 | 3/1973 | Scheffee | 280/150 AB |
| 3,756,621 | 9/1973 | Lewis et al. | 280/150 AB |
| 3,767,228 | 10/1973 | Lewis | 280/150 AB |
| 3,778,084 | 12/1973 | Sutherland | 280/150 AB |

*Primary Examiner*—S. Clement Swisher
*Assistant Examiner*—Denis E. Corr
*Attorney, Agent, or Firm*—Edmund M. Jaskiewicz

[57] ABSTRACT

A location indicator for lost aircraft comprises a deflated balloon stored within an aircraft is connected to an inflator which is capable of generating a large quantity of lighter-than-air gas in less than one second in response to an omnidirectional crash sensor to inflate the balloon. The balloon is connected to the aircraft by a reeled line which becomes unreeled as the inflated balloon rises from the aircraft. The balloon is thus maintained at a predetermined height above the aircraft so as to be clearly visible for a long distance.

4 Claims, 6 Drawing Figures

LOCATION INDICATOR FOR LOST AIRCRAFT

The present invention relates to a location indicator for lost aircraft, more particularly, to the immediate and rapid inflation of a balloon in response to a crash sensor.

Because of the widespread use of all forms of aircraft in virtually all countries of the world, it is inevitable that mishaps will occur and occasionally an aircraft will crash. Many times such aircraft crashes occur in jungles, in mountaineous country, or in sparcely settled areas which make searching for such a downed aircraft very difficult. Aircraft have been known to crash deep in the jungles and the crashed aircraft was never located. Occasionally such aircraft are inadvertently located at some later time by persons who may be in that part of the country for entirely different reasons. Such crashes of aircraft in virtually inaccessible areas such as jungles have resulted in great tragedies even when many of the passengers on the aircraft actually survived the crash.

Various proposals have been made in an attempt to facilitate the locating of such lost aircraft. One such proposal as disclosed in U.S. Pat. No. 1,836,495 consisted of a balloon which was inflated from a tank of compressed gas located on the aircraft when the aircraft was subjected to a sufficient shock or impact such as would occur as a result of a crash. The inflated balloon was connected by a line to the aircraft and would rise to a height where it would be visible and thus facilitate searching. This locator had the disadvantage that the inflating of the balloon was a relatively slow operation. The present day speeds of aircraft today would cause a crash to occur in such a short period of time that the locator as previously known could not possibly function to inflate the balloon in time prior to destruction of the aircraft and the inflating mechanism. In a crash situation the balloons and the entire system controlling them would be damaged or destroyed before they could be released.

It is well known that the actual crash of an aircraft occurs extremely quickly. Survivors have often stated they could not be precisely sure of exactly when the crash occurred. It is apparent that under these circumstances any locator for lost aircraft must be able to function almost instantaneously upon the occurrence of a crash.

It is therefore the principal object of the present invention to provide a novel and improved indicator for lost aircraft.

It is another object of the present invention to provide a location indicator for lost aircraft wherein a balloon is inflated almost instantaneously with a lighter-than-air gas in response to a crash impact upon the aircraft.

It is a further object of the present invention to apply to the location of lost planes the air cushion principles used lately to minimize the effects of motor car accidents, in which the factor speed is the vital one.

According to one aspect of the present invention a large inflatable balloon is positioned in the upper part of the fuselage of the aircraft in deflated condition. Should the aircraft be subjected to a crash or impact, a crash sensor device would trigger a release mechanism which would discharge high pressure gas into the balloon which would then be almost instantaneously expelled into the atmosphere. The entire sequence of impact, inflation and ascension requires only a fraction of a second because of the rapid expansion of the gas in the inflator. The inflator combines a small cylinder of stored gas with a solid propellant. In a crash, the sensor triggers the inflator, breaking the seals on the gas storage cylinder and venting the inert gas into the balloon. Simultaneously, the solid propellant ignites and burns to produce a large quantity of gas which flows into the balloon inflating it fully. The door of the fuselage compartment in which the balloon is stored opens widely upon impact. The inflated balloon is violently ejected into the atmosphere as a result of its almost instantaneous buoyancy and will remain connected to the fuselage by a special line which is unreeled as the balloon rises. That portion of the line which is connected directly to the aircraft is made of a metallic chain or some other fire-resistant material so as to withstand the heat of flames in the event of fire.

Other objects and advantages of the present invention will be apparent upon reference to the accompanying description when taken in conjunction with the following drawings, which are exemplary, wherein.

Figure 1:
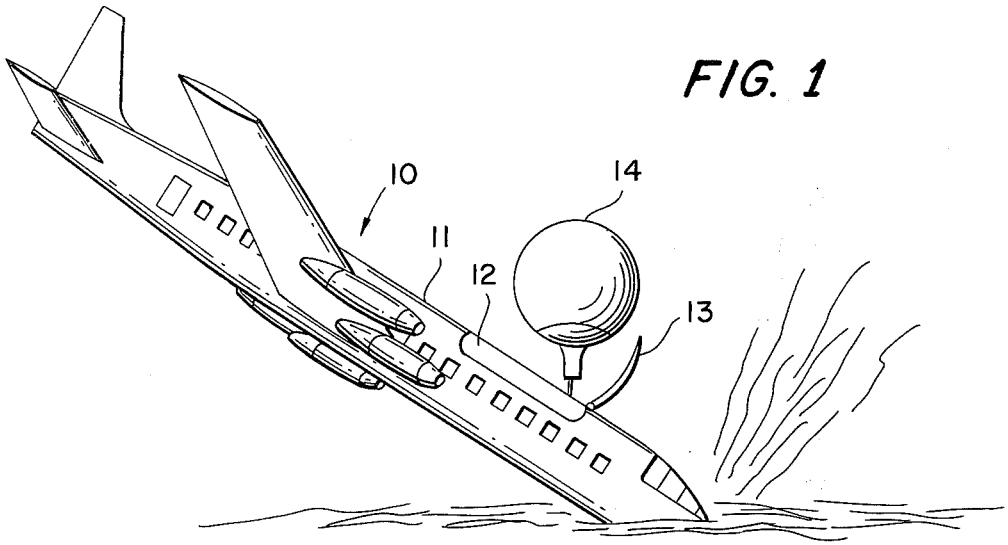
FIG. 1 is an overall perspective view of an aircraft incorporating the indicator device of the present invention at the moment of impact and showing the release of the inflated balloon.

Proceeding next to the drawings wherein like reference symbols indicate the same parts throughout the various views a specific embodiment of the present invention will be described in detail. As may be seen in FIG. 1 there is indicated generally at 10 an aircraft of the large passenger type having a fuselage 11 in the upper portion of which is a compartment 12 closed by a lid or door 13 which opens upon impact of the aircraft. The compartment should be located in the upper portion of the fuselage or wing of the aircraft. Where the invention is incorporated in other types of aircraft such as flying boats or high wing monoplanes the compartment may be located in the top surface of the wing. Further, while only one compartment is shown a plurality of compartments may be located in various portions of the aircraft so that in the event one compartment with its included mechanism cannot function as a result of damage incurred in the crash or otherwise at least one other compartment with its inflatable balloon will be able to operate.

In the compartment 12 there is stored an inflatable balloon 14 which is in the deflated condition and properly folded so as to be readily inflatable upon the introduction of gas therein. The balloon 14 should be sufficiently large so as to be seen from a considerable distance. Such a balloon may be similar to a weather balloon which is approximately 8 feet in diameter although larger balloons may be employed. The balloon should be made of a rubberized material of great resistance and should have sufficient elasticity and resiliency to be filled instantly with gas at the time of impact. The material should be impermeable to the gas so that there will be no seeping of gas through the pores of the inflated balloon. It is desirable that the balloon remain inflated for a long period of time so as to be visible throughout the course of a search.

The balloon should be colored so as to be clearly visible and such a color might be red or orange. The color should be luminescent in order to reflect sunlight and light beams of search planes. In order to facilitate identification of the plane each balloon should bear on its surface the identification letters and numbers of the plane.

Figure 3:
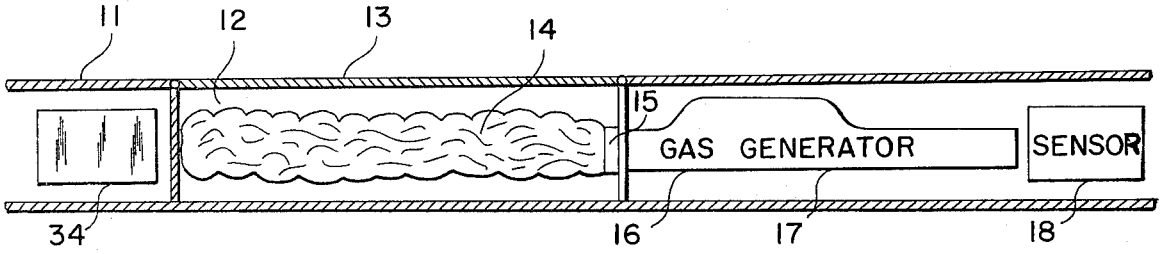
FIG. 3 is a longitudinal sectional view of the upper portion of the fuselage of the aircraft in FIG. 1 showing the deflated balloon stored in a compartment.

The balloon 14 is provided with a mouth end 15 (FIG. 5) which is releaseably connected to a discharge nozzle 16 (FIG. 3) of an inflator 17 (FIG. 3) mounted immediately below the top surface of the fuselage 11 and adjacent the compartment 12.

Mounted next to the inflator and connected thereto is a crash sensor 18 having an omnidirectional sensing capability such that the sensor can be set to activate the inflator system from various angles ranging from about 30° to either side of the travel direction of the aircraft. Such sensors are presently employed with motor vehicle air cushion systems.

Figure 4:
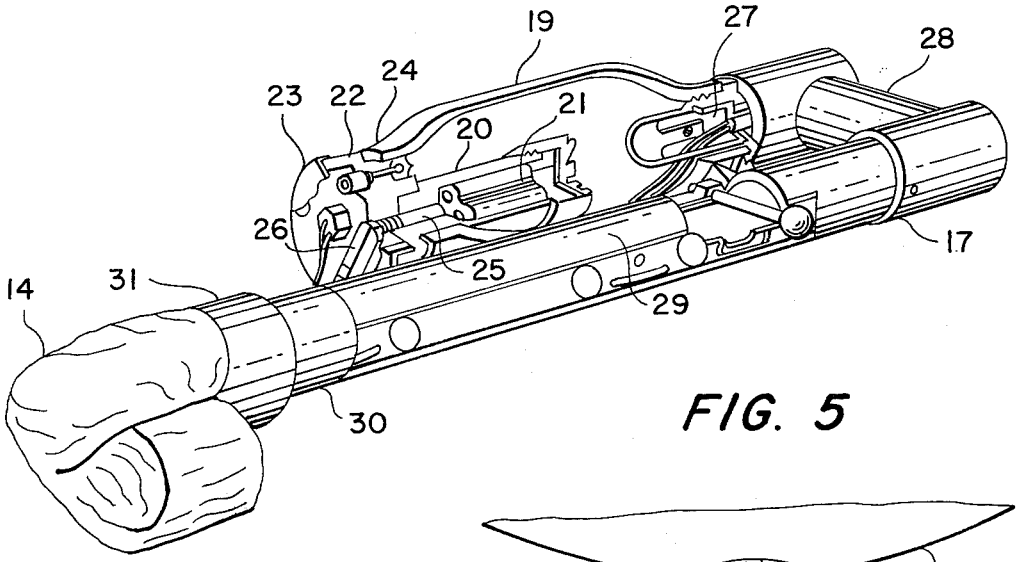
FIG. 4 is a cut-away perspective view of the inflator employed to generate gas to inflate the balloon.

The inflator 17 is shown in greater detail in FIG. 4 and comprises a typical hybrid air cushion inflation system which combines a small cylinder of stored gas with a solid propellant. When the aircraft is subjected to an impact, the sensor triggers the inflator, breaking the seal on the gas storage cylinder and venting the inert gas into the balloon. Simultaneously, the solid propellant ignites and burns producing a large amount of gas which quickly flows into the balloon to fully inflate it.

The inflator 17 comprises a tank 19 in which an inert gas is stored under pressure. Mounted within the tank 19 is a gas generator 20 within which is a powder charge or solid propellant 21 which when ignited will produce a gas which is lighter-than air. The generator 20 is mounted within a body portion 22 enclosed by a protective cap 23 and retained within end 24 of the pressure tank 19.

Also within the tank 19 is an initiator 23 for igniting the propellant 21 and connected through 25 through a gas generator circuit to the sensor 18.

Connected to the other end of the tank 19 within which is an actuator retainer 27 is a diffuser 28 which communicates through a pipe 29 to the balloon 14 through discharge nozzle 30.

Figure 5:
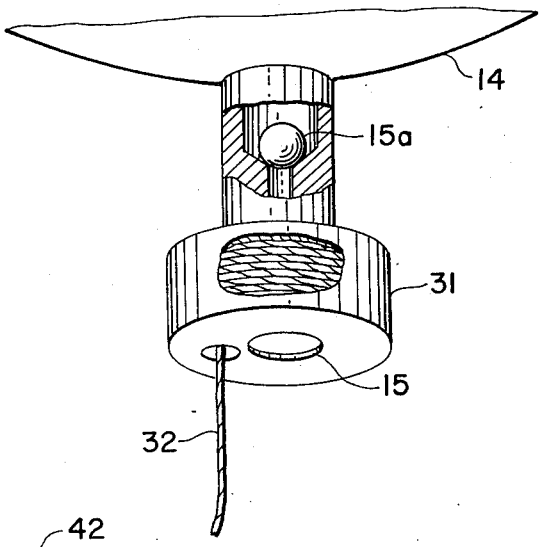
FIG. 5 is an elevational view of the mouth end of the balloon with a cut-away portion to show the check valve therein and the reeled line attached to the mouth.
Figure 6:
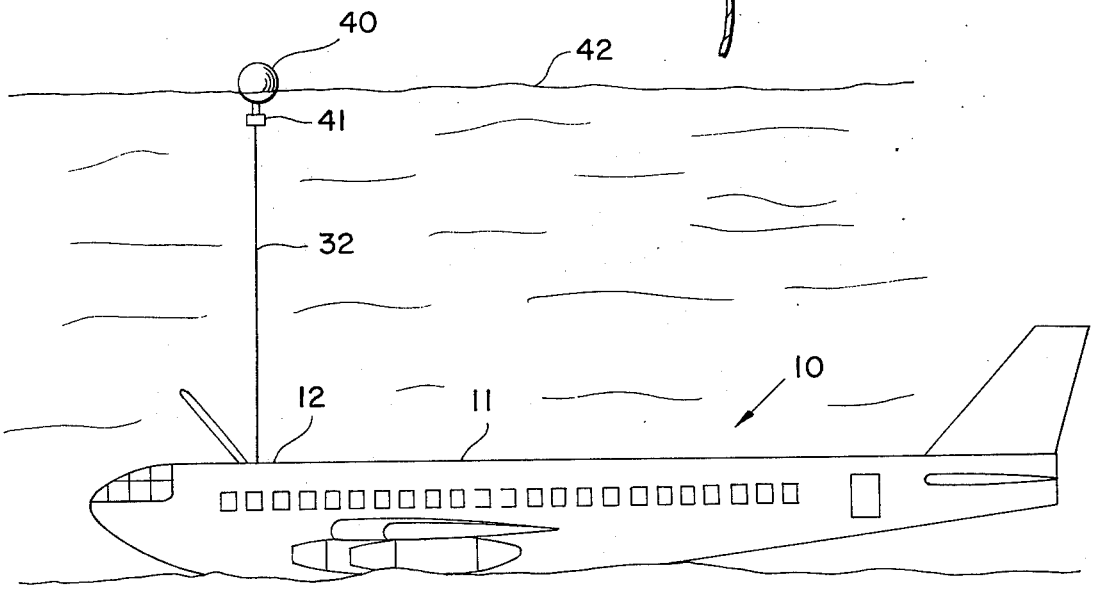
FIG. 6 is a view similar to that of FIG. 1 but the downed aircraft submerged in water.

The balloon mouth 15 is releaseably attached to the discharge nozzle 30 so that upon inflating of the balloon the balloon will be readily released from the inflator. Disposed within the mouth 15 of the balloon is a check valve 15*a* which may be of the ball check (as shown in FIG. 5) or other known type so as to permit the introduction of gas into the balloon but will retain the gas once the balloon is inflated.

Figure 2:
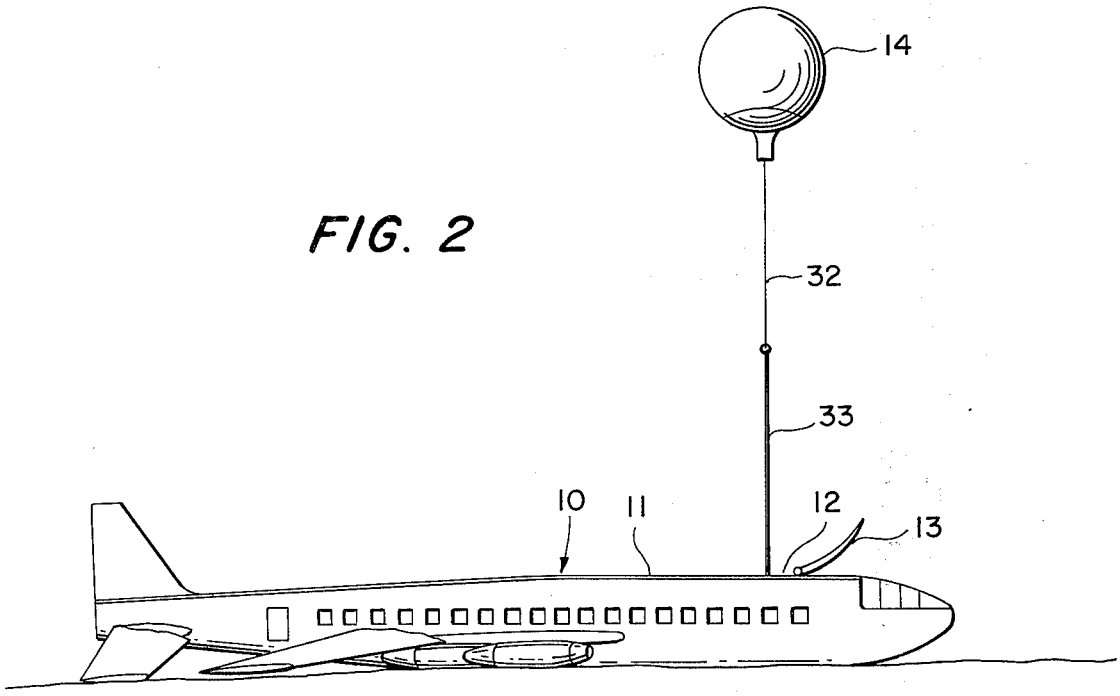
FIG. 2 is an overall perspective view showing a downed aircraft with the balloon in the ascended indicating position.

An annular container 31 having a reel of cable or other line is attached to the mouth 15 of the balloon around the passage leading into the balloon so that the line is unreeled at 32 as the balloon becomes buoyant and rises from the aircraft. The reeled line may also be mounted within the compartment of the aircraft and attached to the balloon. The line should be of sufficient length so as to allow the balloon to rise to a height to be clearly visible. Preferably the line should be from five to ten thousand feet in length. That portion of the line adjacent the aircraft and indicated at 33 in FIG. 2 should be of a chain or other flame and heat resistant material so as to prevent destruction of the line in the event that the aircraft catches fire.

A sound alarm 34 is connected to the inflator 17 so as to produce a loud noise as an audio signal. The alarm may be actuated by batteries of the solar type so as to be rechargeable by the suns rays and thus to continue to produce a sound alarm for a long period of time.

For aircraft which are scheduled to fly over large bodies of water the locator may comprise a balloon 40 which has attached thereto a weight 41 of sufficient mass so as to permit the balloon 40 to float on the surface of the water 42 in which the craft 10 has fallen. The presence of the weight will thus prevent the balloon from continuing to rise in the air and the balloon will float on the water. As previously, the balloon is attached by cable 32 to the compartment 12 of the aircraft. Otherwise, this locator structure is the same as described previously.

It is also possible to provide a small catapult which is triggered by the line of one of the rising balloons which would discharge the weight from the aircraft into the water. The balloon and weight may be ejected from the aircraft without the line 32. Thus, the balloon would be free to float on the surface of the water to indicate the area in which the plane is submerged. In view of the known winds and currents on the surface of the water it is preferable that the balloon remain attached to the aircraft so as to indicate with some degree of certainty the location of the submerged aircraft.

The mechanism for actuating the inflator may also be triggered manually by the operator. Under those circumstances when the crew of the aircraft are aware that a crash is impending, the crew may actuate the mechanism to discharge the locator balloon prior to the balloon being actuated by the crash sensor.

An automatically actuated radio transmitter may also be attached to the balloon to transmit a signal as a further aid in locating the aircraft.

While the invention has been described for use with aircraft it is to be understood that this same locator can be used for other vehicles and marine craft, particularly, with submarines. A disabled submarine can thus quickly indicate its position by discharging an inflatable balloon as described above.

Thus it can be seen that the present invention has provided an indicator for lost aircraft which operates almost instantaneously upon the crash of the aircraft to inflate a balloon which is then ejected from the aircraft and rises into the air. The balloon is attached to the aircraft by a cable which is unreeled as the balloon rises so as to maintain the balloon in a spaced relationship to the aircraft to locate its precise position. The rapid operation of this device permits reliable operation of the locator even during those brief intervals of time upon the occurrence of a crash of an aircraft traveling at high speeds. By providing the locator with an air cushion inflator such as used in automobiles to inflate the air cushion in a fraction of a second it is apparent that the balloon similarly will be inflated in less than a second in response to a signal generated by a crash sensor located on the aircraft.

It will be understood that this invention is susceptible to modification in order to adapt it to different usages and conditions, and accordingly, it is desired to comprehend such modifications within this invention as may fall within the scope of appended claims.

What is claimed is:

1. A location indicator for lost aircraft comprising omnidirectional crash sensor means, means comprising an automobile air cushion inflator for generating a charge of lighter-than-air gas in response to said crash sensor means, said inflator comprises a small cylinder of stored gas and a solid propellant which produces a large amount of gas upon burning, an inflatable balloon having a check valve in the mouth thereof releaseably attached to said gas generating means in the deflated condition to receive said charge of gas so as to become inflated and buoyant in less than 1 second, and a reeled line connecting the balloon to the aircraft so that the balloon is maintained in spaced relation to the aircraft.

2. A location indicator as claimed in claim 1 and a weight on the balloon so that the balloon will float on the surface of the water should the balloon become released when the aircraft is submerged in water.

3. A location indicator as claimed in claim 1 and a luminescent coating on the balloon.

4. A location indicator as claimed in claim 1 and further comprising an aircraft fuselage having a compartment in an upper portion thereof, a door closing said compartment and opening upon impact of the aircraft, said balloon being disposed in said compartment.

* * * * *